US005836066A

United States Patent [19]

Ingram

[11] Patent Number: 5,836,066

[45] Date of Patent: Nov. 17, 1998

[54] PROCESS FOR THE PRODUCTION OF TWO-WAY SHAPE MEMORY ALLOYS

[75] Inventor: Richard B. Ingram, Aurora, N.Y.

[73] Assignee: Innovative Dynamics, Inc., Ithaca, N.Y.

[21] Appl. No.: 681,028

[22] Filed: Jul. 22, 1996

[51] Int. Cl.[6] ..... B21C 37/00

[52] U.S. Cl. ..... 29/90.7; 29/447; 29/469.5; 148/563; 72/53

[58] Field of Search ..... 29/90.01, 90.7, 29/447, 458, 469.5; 148/563; 451/53, 55; 72/53, 342.5

[56] References Cited

U.S. PATENT DOCUMENTS

| | | | |
|---|---|---|---|
| 4,411,711 | 10/1983 | Albrecht et al. . | |
| 4,518,444 | 5/1985 | Albrecht et al. . | |
| 4,637,962 | 1/1987 | Albrecht et al. . | |
| 4,899,543 | 2/1990 | Romanelli et al. . | |
| 4,935,068 | 6/1990 | Duerig | 148/563 |
| 5,624,508 | 4/1997 | Flomenblit et al. | 148/563 X |
| 5,641,364 | 6/1997 | Goldberg et al. | 148/563 |
| 5,686,003 | 11/1997 | Ingram et al. | 219/201 |

OTHER PUBLICATIONS

"Linear And Non–Linear Superelasticity In Ni –Ti," Zadno et al., *MRS Int'l Mtg. On Adv. Mats,* vol. 9 (1989), pp. 201–203. .

*Primary Examiner*—S. Thomas Hughes
*Attorney, Agent, or Firm*—J. De La Rosa

[57] ABSTRACT

The present invention for producing a substantial two-way shape memory effect within a composition substantially only exhibiting one-way memory is realized by first plastically deforming the alloy into a predetermined shape and then work hardening, such as through grit blasting, a selected portion of the outer surface of the alloy. Advantageously, this later type of work hardening selectively transforms only the outer portion of the alloy into a region of "super-elasticity" which acts as a biasing force to re-strain the alloy upon cooling. As such, two-way shape memory elements—which recover their original shape upon heating, yet deform into a second desired shape upon cooling—may be made to produce actuators exhibiting strain amplitudes of as much as 3% while exerting a force in excess of about 10,000 psi. Moreover, the alloy elements may be judiciously processed to perform movement in direct tension, expansion, bending, or torsion or any combination thereof while exerting force, and operating over large cycle numbers.

30 Claims, 15 Drawing Sheets

100

Heat
100
ΔX

Cool
100

Heat
100

Cool
100

200

Cold Working and Heat Treatment
ΔX
200
210

F
T
Plastic Deformation
230
240
250

240'
230'
Work Hardening 200
240
250
240'

ΔX
200

Heat
200

Cool
200

Heat
200

Cool

Cool
200
400
400
410
410
400'
400'
240
250
240'
ΔX

Heat
200
400
400
410
410
400'
400'
240
250
240'

(a)

(b)

(a)

(b)

(a)

(b)

PROCESS FOR THE PRODUCTION OF TWO-WAY SHAPE MEMORY ALLOYS

STATEMENT REGARDING GOVERNMENT-FUNDED RESEARCH

This invention was made under Government support under Contract No. NAS3-26612, awarded by the National Aeronautics and Space Administration. The Government may have certain rights to this invention.

TECHNICAL FIELD

The present invention relates to shape memory alloys and, more particularly, to a method for producing a substantial two-way shape memory effect within an alloy substantially only exhibiting one-way memory.

BACKGROUND OF THE INVENTION

Several families of alloys are well known in the art to exhibit shape memory properties which enable them to be used as mechanical devices, such as actuators. For example, Ni-Ti also known as Nitinol or Tinel, exhibits shape memory properties through a solid to solid phase change which occurs over a transformation or transition temperature range, aided by a crystallographic property called "reverse twinning." More specifically, at temperatures below the transformation temperature range, Ni-Ti is in a stable solid phase known as martensite, yielding a ductile material. At temperatures above the transformation temperature range, however, Ni-Ti is in a solid phase known as austenite, yielding a hard material. When Ni-Ti is plastically deformed while in its martensite phase, it has the ability to return to its pre-deformed shape when heated above its transformation temperature range. Similarly, other shape memory alloys such as Cu-Al-Ni, Cu-Al and the like, if plastically deformed recover their original shape when raised above their transformation temperature range. This transformation temperature range is determined primarily by the particular alloy composition, and secondarily by various processing factors. For Ni-Ti, strains of as much as eight percent (8%) can be recovered.

Because of their unique properties, shape memory elements are widely used in mechanical and electro-mechanical systems as simple and compact actuators that exert a force through a movement. However, once the one-way shape memory element has recovered its original shape, the element remains in that shape unless an external mechanism deforms it again. As such, one-way memory actuators must be fitted with a bias force mechanism to deform the one-way shape memory element when it is in soft state so as to set up the potential to perform a repeatable two-way cycle. Moreover, in practice not only must the bias force mechanism perform a high combination of force and movement to deform the shape memory element again, but must also be typically compact. Unfortunately, such bias force mechanisms are typically much bulkier than the shape memory elements themselves, defeating their most important advantage and thereby prohibitively limiting their use. Further, the bias force mechanism by its own nature must continuously exert a load on the actuated mechanism. And, in some situations, this presents a design problem.

Several methods in the prior art have been used to obviate the need for such a bias mechanism by "training" or inducing shape memory elements to exhibit two-way shape memory properties. This allows the element to convert to the "stored" or "memorized" shapes both upon heating and cooling, while driven by temperatures changes alone. Typically, these treatment methods involve repeatably heating and cooling the one-way memory elements while under certain load conditions so that the elements can memorize the process. Still other techniques induce permanent stresses while the shape memory elements are essentially in their sought or original shape. Such stresses are effected by altering the physical properties of corresponding portions of the elements or adding material thereto via lamination. See, for example, U.S. Pat. Nos. 4,411,711 and 4,518,444 to Albrecht et al. which are incorporated herein by reference. These induced stresses result in a biasing force effect which deforms the element away from its original sought shape as it cools below its transformation temperature range.

Although such prior art two-way effect treatment techniques induce the shape memory elements to exhibit two-way shape memory properties, they generally exhibit poor performance. Typically, strain amplitudes of less than 1% are only achieved, which in most cases diminish rapidly with cycle number. Accordingly, there is a need in the prior art for methods which improve the two-way shape memory properties of shape memory elements with respect to strain amplitude and cycle life.

SUMMARY OF THE INVENTION

The present invention for producing a two-way shape memory effect within an alloy substantially only exhibiting one-way memory is realized by first plastically deforming the element into a predetermined shape and then work hardening, such as through grit blasting, a selected portion of the outer surface thereof. Preferably, the element is deformed to the limits of its one-way memory recovery ability. Advantageously, this type of work hardening selectively transforms only the outer portion of the element into a region of "super-elasticity" which provides a biasing force to re-strain the element upon cooling. As such, two-way shape memory elements—which recover their original shape upon heating, yet deform into a second desired shape upon cooling—may be made to produce actuators exhibiting strain amplitudes of as much as 3% while exerting a force in excess of about 10,000 psi. Moreover, the elements may be judiciously processed to perform movement in direct tension, expansion, bending, or torsion while exerting force, and yet attaining a long life cycle with a stable transformation temperature range.

In one embodiment for treating a shape memory alloy sheet, the work hardening apparatus includes a housing; a semi-circular mandrel; a clamping mechanism consisting of steel block clamps; a tension screw; and a grit blast nozzle. A sheet of annealed shape memory alloy is initially processed to perform a one-way shape memory action in any manner well known in the art. For example, the alloy sheet may be cold worked about 10–20% and then heat treated. The shape memory alloy sheet is then plastically deformed over the semi-circular mandrel while under constraint by the steel clamping blocks. In particular, deformation is accomplished by tightening the tension screw, forcing the semi-circular mandrel against the shape memory alloy sheet and thereby stretching the sheet without forming ripples. Preferably, the shape memory alloy sheet is stretched to the limits of its one-way shape memory recovery ability. Glass beads averaging about 10–15 mils in diameter are directed through the jet nozzle under a pressure of 30–60 psi to the exposed surface of the shape memory alloy sheet.

To uniformly expose the outer surface of the shape memory alloy sheet to the grit blasting, the semi-circular mandrel is swept back and forth in front of the grit blast nozzle while the mandrel is rotated at a predetermined interval after each pass. A linear servo is used to translate the mandrel back and forth. Treating the underside surface, if desired, requires that the shape memory alloy sheet be removed from the semi-circular mandrel and repositioned with the untreated surface now exposed and facing the grit blast nozzle. Subjecting the outer surface of the shape memory alloy sheet to this action abrades and converts the outer surface to a super-elastic material which in turn provides the re-straining action or biasing force in the shape memory element.

BRIEF DESCRIPTION OF THE DRAWINGS

The features and advantages of the present invention will become more readily apparent from the following detailed description of the invention in which like elements are labeled similarly and in which.

DETAILED DESCRIPTION

The present invention for producing a two-way shape memory effect within an alloy only exhibiting one-way memory is realized by first plastically deforming the alloy into a predetermined shape, preferably to the limits of its one-way memory properties, and then work hardening a selected portion of the outer surface of the alloy. Advantageously, this work hardening selectively transforms only an outer portion of the alloy into a region of "super-elasticity" which provides a biasing force to re-strain the alloy upon cooling.

Without any loss of generality or applicability for the principles of the present invention, in the embodiments herein below, the description is with respect to the alloy element being plastically deformed along a single axis or direction. It should, however, be clearly understood that the present invention is equally applicable to such a deformation along two axes or directions to effect two-way movement along two dimensions upon heating and cooling.

Figures 1A, 1B, 1C, 1D, 1E:
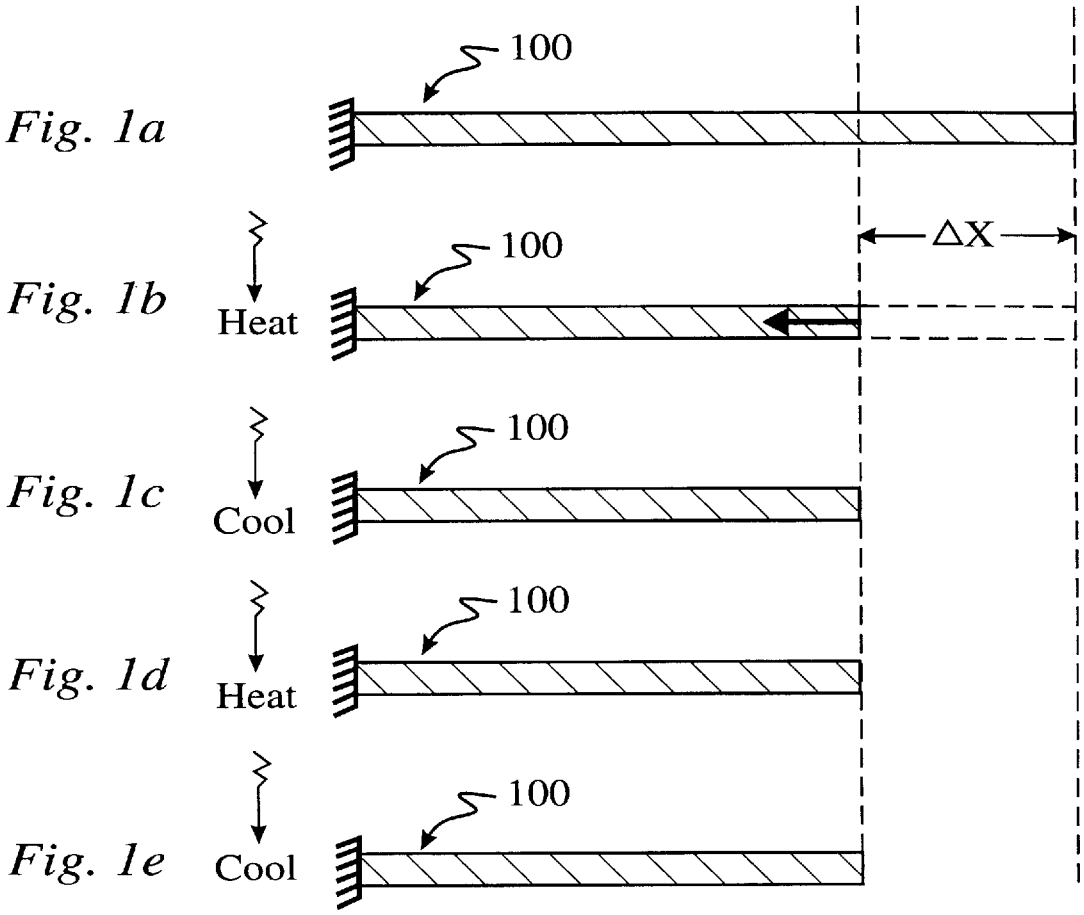
FIGS. 1(*a*)–1(*e*) are a representation of the one-way memory effect of a cross sectional view of a shape memory element processed to exhibit one-way memory.

Shown in FIG. 1 is a representation of the one-way shape memory effect of a shape memory element 100, originally processed to exhibit one-way memory. FIG. 1(*a*) depicts shape memory element 100 plastically deformed in tension while in its cold or soft phase. Upon heating over its transformation temperature range, shape memory element 100 recovers its original shape as depicted in FIG. 1(*b*). As illustrated in FIG. 1(*c*), when cooled, however, shape memory element 100 will not revert to its original deformed shape of FIG. 1(*a*). Nor, will the shape memory element change its shape if reheated again as illustrated in FIG. 1(*d*), or if cooled again as illustrated in FIG. 1(*e*). It should be clearly understood that FIG. 1 depicts a shape memory element in its initial state prior to the inducing of the two-way memory effect in accordance with the principles of the present invention. A two-way memory effect allows the element to be repeatedly cycled between two different predetermined shapes in response to temperature changes alone. One-way processed and unprocessed shape memory alloys may be widely purchased from a number of suppliers, such as, for example, Special Metals Inc., located in New Hartford, N.Y.

Figures 2A, 2B, 2C:
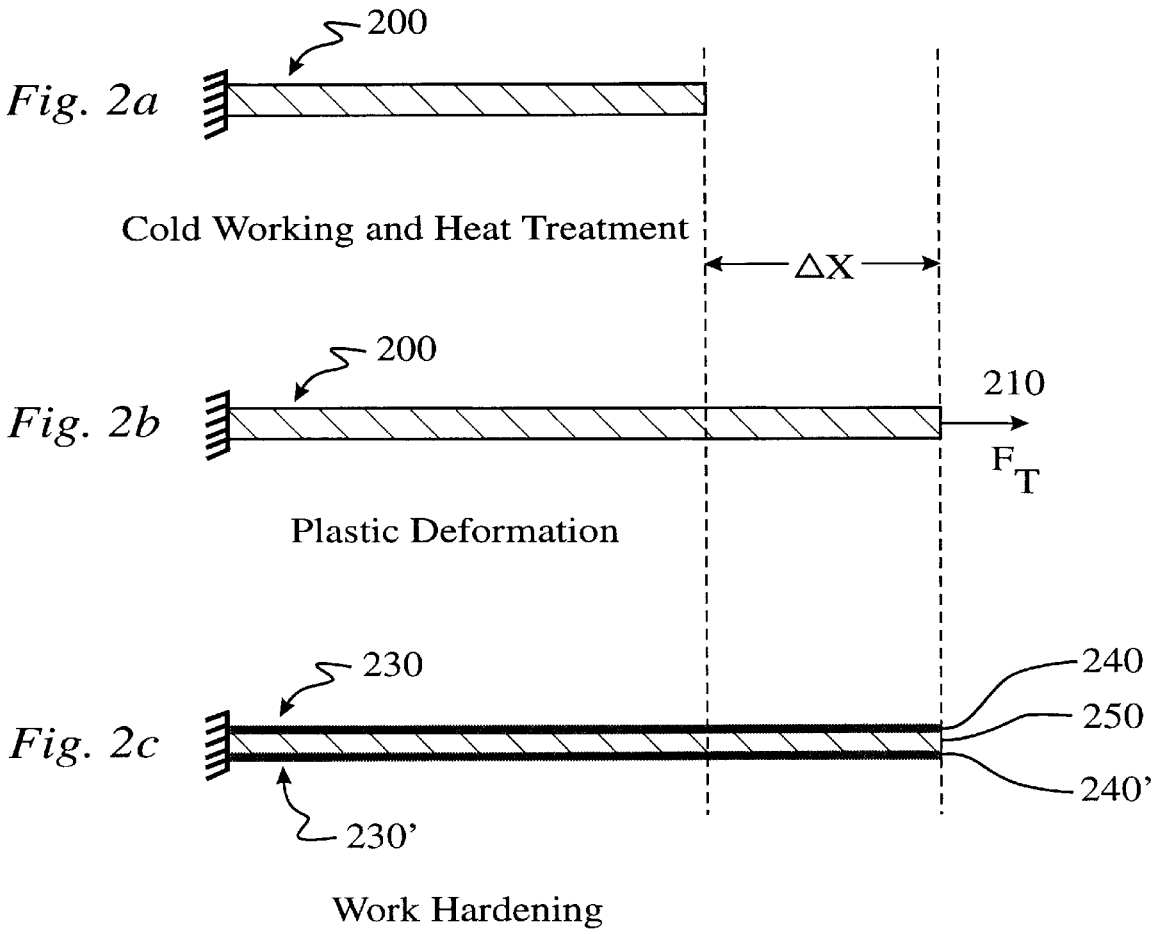
FIGS. 2(*a*)–2(*c*) are a representation of the two-way memory effect treatment of the present invention performed on a cross sectional view of a shape memory element.

Referring to FIG. 2(*a*), to induce the two-way memory effect so as to perform a tensile movement, a shape memory element 200 is first conditioned with preliminary cold working and heat treatment in a manner well known to those skilled in the art to obtain a satisfactory one-way memory effect. That is, the desired shape the element recovers to when heated is set by plastically deforming and constraining the element to that shape and then heat treating the element. For instance, for nickel-titanium alloys—more commonly known as Nitinol or Tinel—a typical heat treatment may be performed at about 550° C. for ten minutes. For the sake of clarity, however, such well known heat treatments will not be discussed in detail herein. Alternatively, shape memory elements pre-treated to exhibit one-way memory may also be widely purchased.

Once the desired sought shape is set, an external force, $F_T$, 210—as illustrated in FIG. 2(*b*)—is applied to shape memory element 200 to first plastically deform the element to a predetermined shape. Preferably, shape memory element 200 is deformed near or to the limits of its one-way memory recovery ability. This plastic deformation prior to work hardening importantly sets up the potential for the alloy to exhibit a substantial two-way memory. Strain amplitudes of as much as 3% may be obtained. For example, shape memory element 200 may be deformed by lengthening the element by an amount ΔX under direct tensile plastic strain as illustrated in FIG. 2(*b*). This plastic deformation is effected while element 200 is in its soft state, which occurs below its transformation temperature range. Those skilled in the art will readily note that shape memory element 200 remains in this deformed shape unless heated into its transformation temperature range. When heated through its transformation temperature range, however, element 200 recovers its original shape of FIG. 2(*a*). If shape memory alloy element 200 is instead compressed, the alloy would expand when heated. And, likewise, if shape memory alloy element 200 is either bent or twisted, it would still recover its original shape of FIG. 2(*a*) upon heating above its transformation temperature range.

As shown in FIG. 2(*c*), to induce two-way memory so as to cause element 200 when heated to recover to the shape of FIG. 2(*a*) yet when cooled to recover the shape of FIG. 2(*b*), outer surfaces 230, 230' of shape memory element 200 is work hardened while the shape memory element remains plastically deformed and constrained to maintain this deformed shape. Some prior art techniques attempt to induce two-way memory by work hardening the element when it is initially in its undeformed state. This, however, results in a low strain amplitude since shape memory portion 250 has little or no strain to recover from. Although the surface work hardening only may deform portion 250, this deformation is substantially minimal and is difficult to control.

In accordance with the principles of the invention, work hardening is preferably effected by selectively grit blasting the outer surface, making only a portion of the worked surface super-elastic which induces elastic resistance against the one-way movement of the unaffected shape memory portion 250. It should be understood that "super-elastic" herein means an enhanced linear and reversible strain (>1%) without exhibiting significant one-way memory properties. This super-elasticity, herein tensile, re-strains the underlying one-way shape memory alloy when it is in its soft state as discussed more fully herein below. Those skilled in the art will readily note that two-way memory element 200, in effect, now consists of super-elastic regions 240, 240' and underlying one-way memory region 250, as illustrated in FIG. 2(*c*).

Figures 3A, 3B, 3C, 3D, 3E:
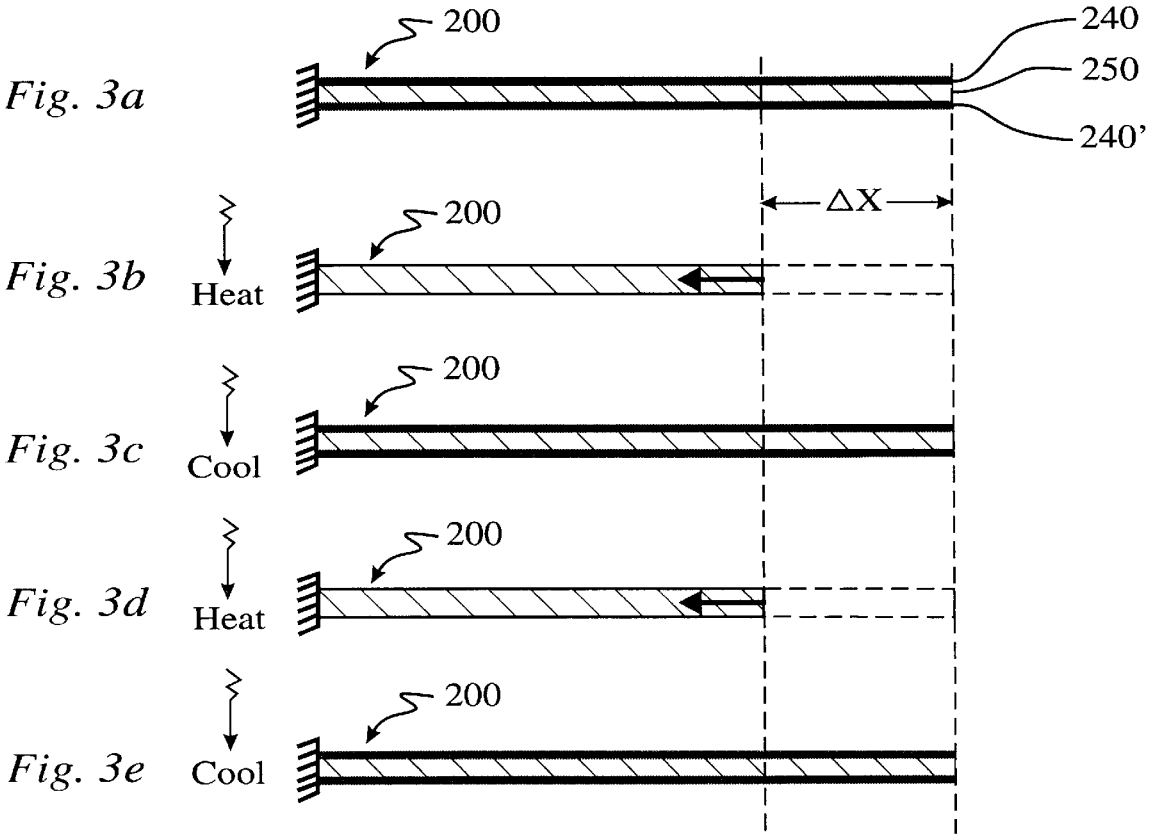
FIGS. 3(*a*)–3(*e*) are a representation of the two-way memory effect of the shape memory element of FIG. 2.

Now referring to FIG. 3, if shape memory element 200 is heated above its transformation temperature range, shape memory element 200 initially contracts parallel along to its longitudinal axis by an amount ΔX due to the induced one-way memory. This is illustrated in FIG. 3(*b*). Referring to FIG. 3(*c*), after cooling below the transformation temperature, shape memory element 200 returns to its pre-processed shape of FIG. 3(*a*) due to the tensile elastic stress exhibited by super-elastic regions 240, 240'. Subsequent heating and cooling above and below the transformation temperature contracts and expands shape memory element 200, respectively, with a strain amplitude as illustrated in FIGS. 3(*d*)–(*e*). Partial strain amplitudes, i.e., less than ΔX, can be induced by partially cycling within the transformation temperature range.

In order to achieve the highest strain amplitude, however, the proportion of super-elastic regions 240, 240' to one-way shape memory region 250 should be judiciously selected by work hardening outer surface 230 to a specific depth. Work hardening surfaces 230, 230' too deeply or too lightly converts too much or too little of shape memory region 250 to super-elastic regions 240, 240', which in turns induces too much or too little re-straining action, respectively, therein. In either of the latter cases, the strain amplitude in practice is somewhat less than its optimum amplitude, ΔX. Empirical data may be used to determine the amount of work hardening for a particular alloy sample required to optimize the strain amplitude, ΔX.

Figures 4A, 4B:
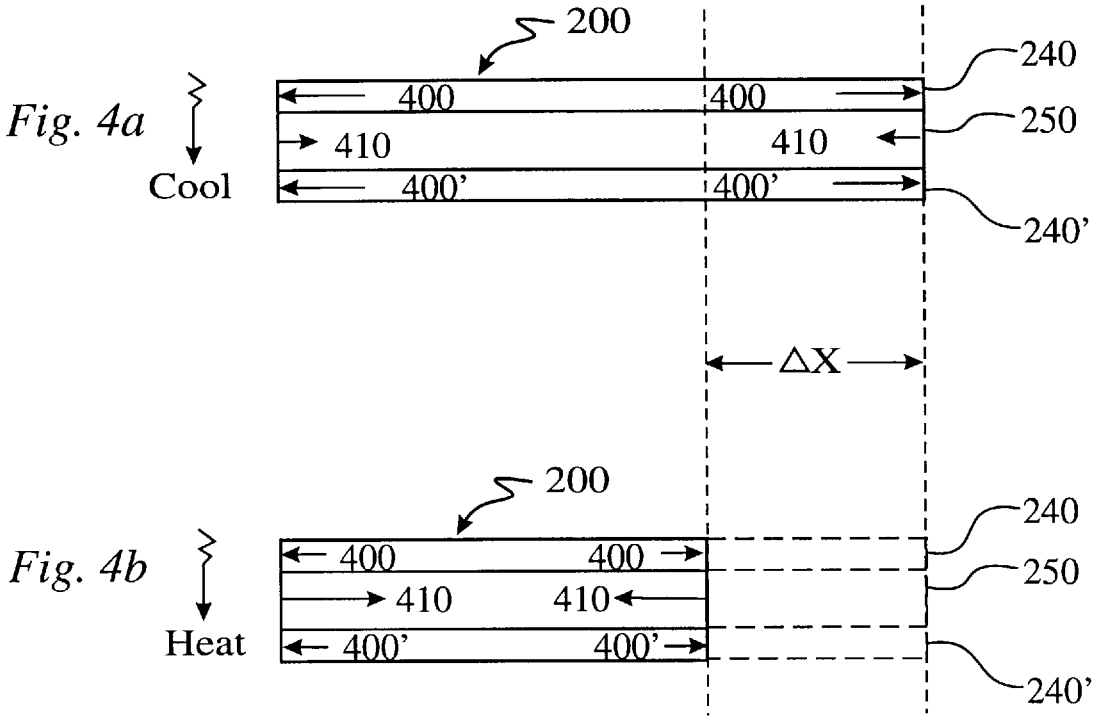
FIGS. 4(*a*)–4(*b*) are a representation of the internal mechanism of the two-way memory effect of the shape memory element of FIG. 2.

To better understand the two-way memory effect induced by the present invention, it is advantageous to discuss the internal mechanics thereof with reference to FIG. 4. The relative magnitude of the indicated stresses is denoted by the length of the arrows. FIG. 4(*a*) depicts the internal stresses acting on shape memory element 200 when being cooled through its transformation temperature range. It should be understood that one-way shape memory region 250 is in the process of softening. The competing forces include elastic stresses 400, 400' (compressive, but expanding) arising from region 240, 240' and a stress 410 (yield) arising within one-way shape memory region 250, respectively. As shape memory element 200 is cooled, elastic stresses 400, 400' (compressional, but expanding) dominate, causing shape memory element 200 to deform and expand parallel along its longitudinal axis. Elastic stresses 400, 400' weaken, however, with expansion until balanced by stress 410 where element 200 will then just reach the shape indicated by the dash lines of FIG. 4(*b*). That is, shape memory element 200 expands until elastic stresses 400, 400' and stress 410 become equal and opposite. This equilibrium maintains this deformed shape, provided that the shape memory element is not heated into its transformation temperature range.

Now referring to FIG. 4(*b*), as shape memory element 200 is heated into its transformation temperature range, one-way memory region 250 transforms into its hard state. Associated with this is a corresponding increase in magnitude in stress 410 (transformational). As stress 410 (transformational) exceeds elastic stresses 400, 400' (compressive), shape memory element 200 contracts and recovers to its original shape of FIG. 4(*b*), whereby the two stresses become equal and opposite. It should be clearly understood that as one-way shape memory region 250 contracts, elastic stresses 400, 400' increase until they counteract stress 410. Similarly, shape memory element 200 is maintained in this shape unless the element is cooled into its transformation temperature range.

Figure 5:
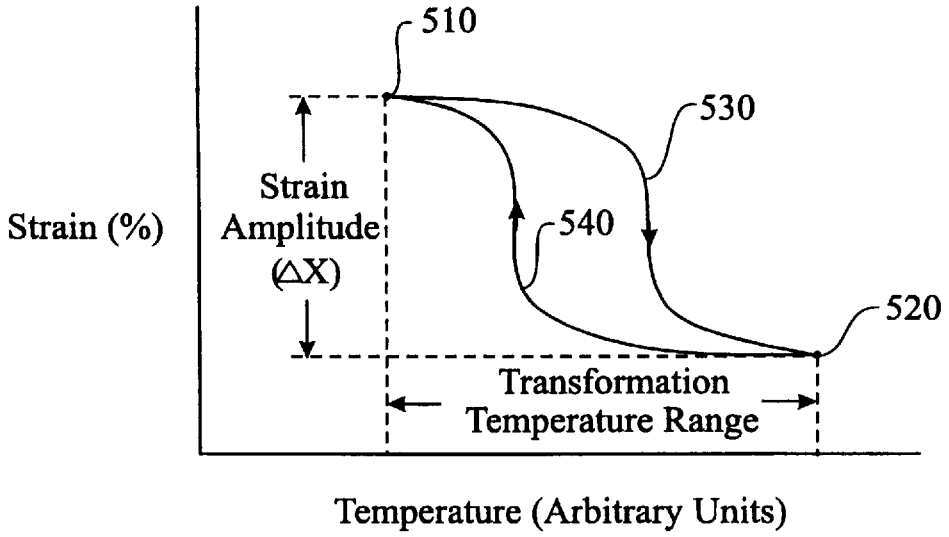
FIG. 5 is an illustrative graph of the strain versus temperature of the two-way memory effect of the shape memory element of FIG. 3.

Shown in FIG. 5 is an illustrative strain versus temperature plot illustrating the two-way memory effect of shape memory element 200 in accordance with the principles of the present invention. The two desired shapes of shape memory element 200 are represented by end points 510 and 520. Heating is depicted along a path 530 whereas cooling is depicted along a path 540. Those skilled in the art will readily note that this behavior as well as the hysteresis effect exhibited in cycling shape memory element 200 between its end points is similar to those of conventional two-way bias force type actuators.

Figure 6:
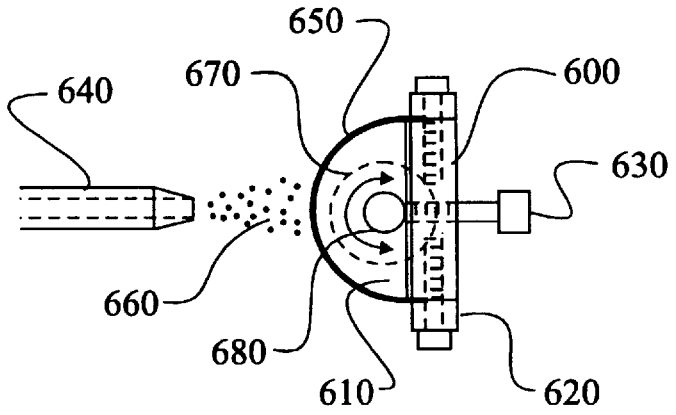
FIGS. 6(*a*) and (*b*) are side and frontal views, respectively, of an illustrative apparatus used in work hardening shape memory alloy sheets in accordance with the principles of the present invention.
Figure 6:
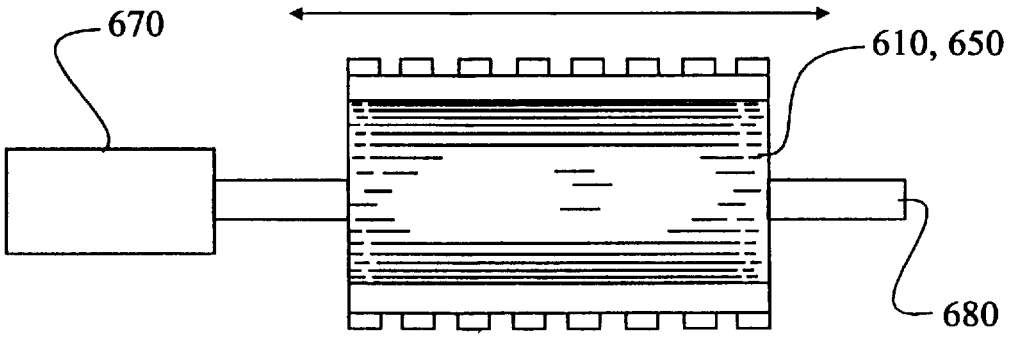

Shown in FIG. 6 is an apparatus in accordance with the principles of the present invention for work hardening through grit blasting the outer surface of shape memory alloy sheets. The work hardening apparatus includes a housing 600; a semi-circular mandrel 610; a clamping mechanism consisting of steel block clamps 620; a tension screw 630; and a grit blast nozzle 640. A sheet of shape memory alloy is initially cold worked about 10–20% in a manner well known to those skilled in the art to a thin sheet and then heat treated at, for example, 550° C. for ten minutes to induce the potential for a significant one-way memory effect. Shape memory alloy sheet 650 is then plastically stretched over semi-circular mandrel 610 to the limits of its one-way memory recovery ability while constrained using steel blocks 620. More specifically, tightening tension screw 630 forces semi-circular mandrel 610 against shape memory alloy sheet 650, thereby stretching the sheet without forming ripples therein. Glass beads 660 that average in diameter of about 10–15 mils are directed through jet nozzle 640 under a pressure of 30–60 psi to the exposed surface of shape memory alloy sheet 650. Grit blast nozzle 640 may have an inner bore diameter of about 0.251' and is positioned about three inches away from shape memory alloy sheet 650.

It should be understood that semi-circular mandrel 610 also acts as an inertial block that counters the impact of the grit blasting. It is believed that this inertial effect causes a more uniform work hardening and therefore a more uniform two-way shape memory effect over the entire surface of the sheet. Further, stretching the shape memory alloy sheet over a convex surface minimizes any tendency for the sheet to form ripples.

To uniformly expose the outer surface of the shape memory alloy sheet to the grit blasting, semi-circular mandrel 610 is swept back and forth in front of grit blast nozzle 640 while mandrel 610 is rotated about a shaft 680 at a predetermined interval with considerable over lap after each pass. A linear sliding servo 670 is used to translate mandrel 610 back and forth. Of course, the process may be fully automated. Treating the underside surface, if desired, requires that shape memory alloy sheet 650 be removed from semi-circular mandrel 610 and repositioned with the untreated surface now exposed and facing grit blast nozzle 640. Preferably, the two-way memory properties are effected by exposing the sheet to grit blasting at a rate of 1 square inch per 20 seconds of blast time.

Subjecting the outer surface of the shape memory alloy sheet to this action abrades and converts the outer surface to a super-elastic material which in turn induces a re-straining action (biasing force) in the alloy sheet. More specifically, it is believed that the grit blasting work hardens the alloy sheet which "pins" the microstructure into its soft state, thereby preventing the one-way shape memory effect from occurring. Moreover, this enhances the elastic range of the alloy sheet. This type of work hardening can be optimized by varying the pressure, the size, type and abrasiveness of the blast particles, the blast time, and the distance of the nozzle from the surface of the shape memory alloy sheet.

Figure 7:
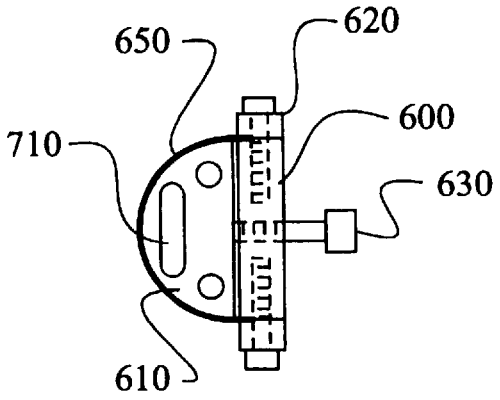
FIG. 7(*a*) and (*b*) are side and frontal views, respectively, of the apparatus of FIG. 6 modified for treating shape memory alloy sheets having low transformation temperatures.
Figure 7:
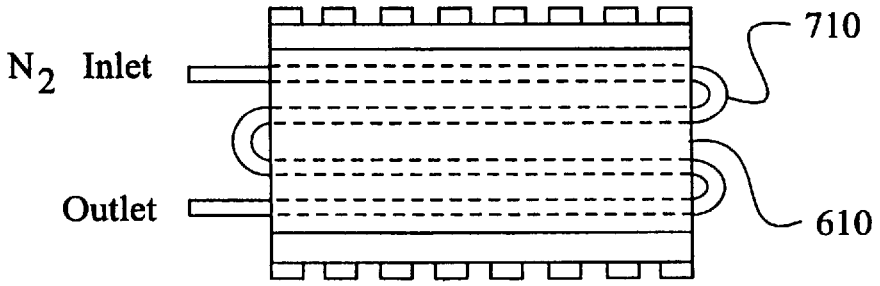

Certain shape memory alloys have a transformation temperature range well below room temperature wherein the alloy is in its hard state. As such, these alloys in accordance with the principles of the present invention are best work hardened at low temperatures where the alloy is in its soft state. For such shape memory alloys, the grit blasting apparatus of FIG. 6 may be modified to include a passageway 710 through which, for example, vented liquid nitrogen gas can be forced to flow, as depicted in FIG. 7. The cold gas maintains mandrel 610 to well below −60° F. Although grit blasting will cause heating, the alloy sheet may be maintained at the desired temperature by periodically stopping the treatment momentarily until the temperature lowers again.

WORKING EXAMPLE I

Figure 8:
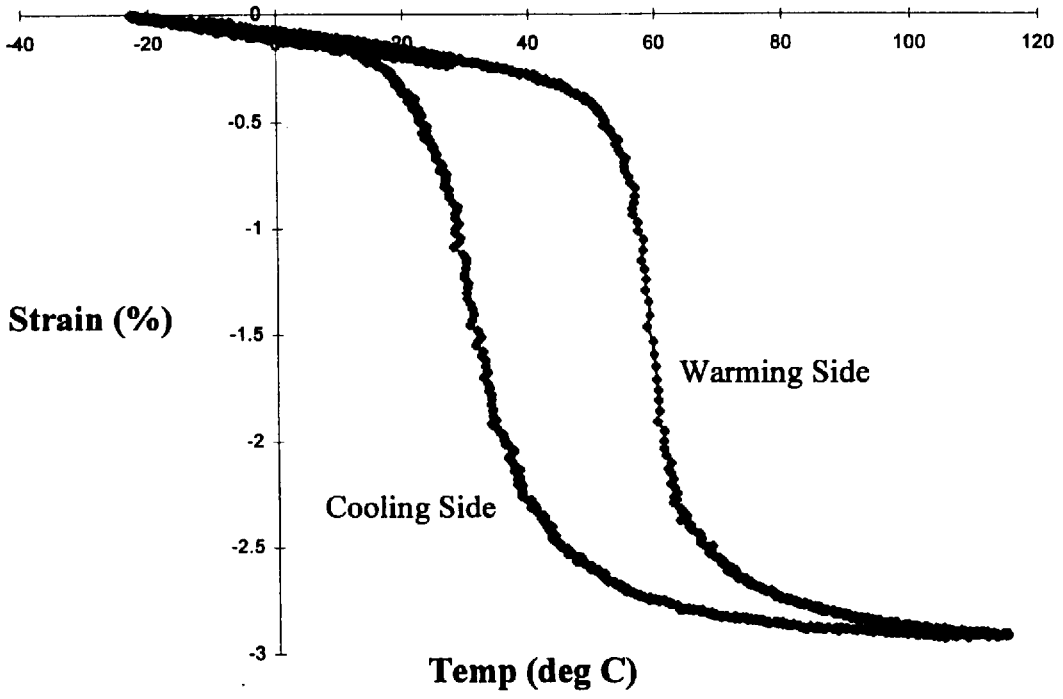
FIGS. 8 and 9 are strain versus temperature plots of shape memory elements processed in accordance with the principles of the present invention.

A binary Ni-Ti shape memory alloy (austenite finish temperature of 55° C.) of dimensions 1.51", wide by 2.75" long was cold worked 20% to a sheet thickness of about 4.7 mils. Those skilled in the art will readily note that the austenite finish temperature is the temperature at which the alloy transforms completely from austenite to martensite. The shape memory alloy sheet was then heat treated at 550° C. for 10 minutes in an oven and air cooled to room temperature to induce the potential for one-way memory. The sample indicated a one-way memory effect of about 6%. During one-way cycling, oxidation scales appearing on the surface of the alloy were also sheared. The sample was clamped within the work hardening apparatus of FIG. 6 and strained to about 6%. Each side of the shape memory alloy ribbon was then subjected to grit blasting using 10–15 mils nominal diameter glass beads at a pressure of 30 psi for 20 seconds per square inch, then repeated with a pressure of 40 psi and then repeated with a pressure of 50 psi. This two-way memory treatment induced a non-load strain amplitude of 2.9%. After cycling the processed shape memory alloy sheet more than a thousand times and tested under stresses of about 4,000–17,700 psi, its strain versus temperature characteristic remained substantially the same and is illustrated in FIG. 8. Further measurements made 740 days later verified the stability of the sample.

WORKING EXAMPLE II

A binary Ni-Ti shape memory alloy (austenite finish temperature of 55° C.) of dimensions 1.5" wide by 2.75" long was cold worked 10% to a sheet thickness of about 4.7 mils. The shape memory alloy sheet was then heat treated at 550° C. for 10 minutes in an oven and air cooled to room temperature to induce the potential for one-way memory. During one-way cycling, oxidation scales appearing on the surface of the alloy were also sheared. The shape memory alloy sheet was clamped within the work hardening apparatus of FIG. 6 and strained to about 5%. Each side of the shape memory alloy ribbon was then subjected to grit blasting using 10–15 mils nominal diameter glass beads in successive sessions at 45 psi for 20 seconds per square inch. After each session, the strain amplitude was measured as follows: 1.1%; 1.23%; 1.5%; 1.66%; 1.74%; and 1.85%.

WORKING EXAMPLE III

A binary Ni-Ti shape memory alloy (austenite finish temperature of 55° C.) of dimensions 1.5" wide by 2.75" long was cold worked 10% to a sheet thickness of about 4.7 mils. The shape memory alloy was then heat treated at 550° C. for 15 seconds using a propane torch and air cooled to room temperature to induce one-way memory. This sample indicated a pre-process one-way memory effect of about 5% strain. During cycling, oxidation scales appearing on the surface of the alloy were sheared. Such oxidation scales are suspected to be detrimental to the inducing of two-way memory.

Then the sample was clamped within the work hardening apparatus of FIG. 6 and strained to 5%. Each side of the shape memory alloy sheet was then subjected to grit blasting using 10–15 mils nominal diameter glass beads at a pressure of 30 psi for 20 seconds per square inch, then repeated with a pressure of 40 psi, and then repeated with a pressure of 50 psi. This sample was installed in a prototype device, and carefully monitored. This two-way memory treatment induced a non-load strain amplitude of 1.6%. While under load stress conditions which varied from zero to 5,700 psi, the processed shape memory alloy sheet was cycled more than ten thousand (10,000) times at a strain amplitude of 1% without developing slack, losing movement, or shifting its transformation temperature range.

WORKING EXAMPLE IV

A Ni-Ti-Cu shape memory alloy (austenite finish temperature of 60° C.) known as alloy K and purchased from Raychem, Inc. of dimensions 1.5" wide by 2.75" long was cold worked 10% to a sheet thickness of about 4.9 mils. The sample was then heat treated at 550° C. for 10 minutes and air cooled to room temperature to induce one-way memory. During one-way cycling, oxidation scales appearing on the surface of the alloy were also sheared. The sample was clamped within the work hardening apparatus of FIG. 6 and strained to 5.5%. Each side of the shape memory alloy sheet was then subjected to grit blasting using 10–15 mils nominal diameter glass beads at a pressure of 50 psi for 20 seconds per square inch. This two-way memory treatment induced a non-load strain amplitude of 1.52%.

WORKING EXAMPLE V

Figure 9:
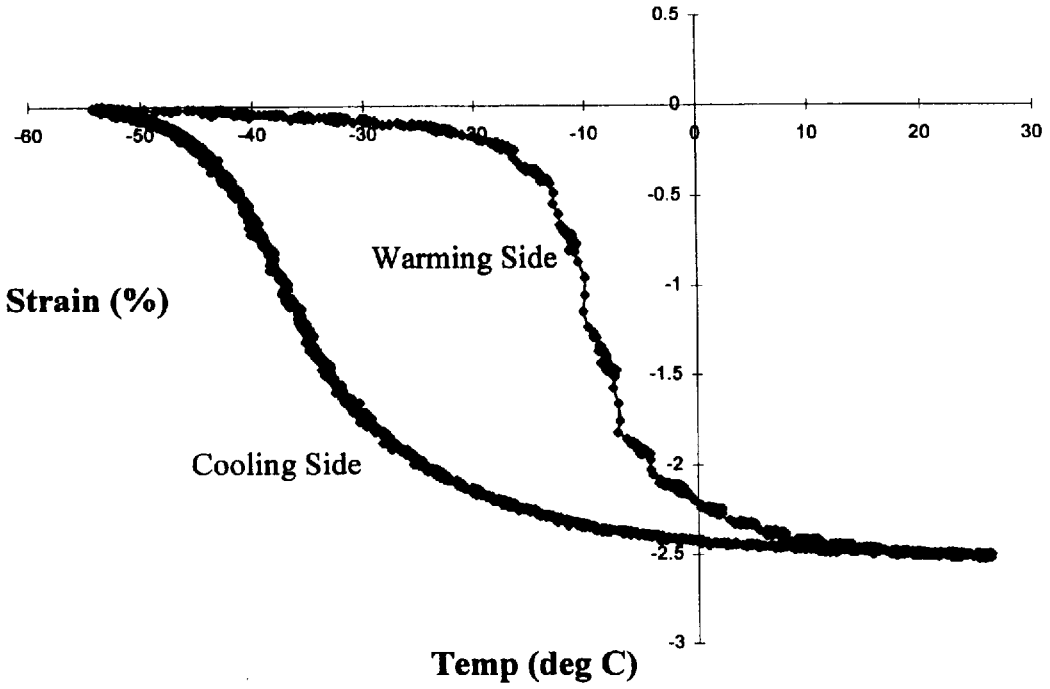

A binary Ni-Ti shape memory alloy (austenite finish temperature of 3° C.) of dimensions 1.5" wide by 2.75" long was cold worked 20% to a ribbon thickness of about 4.2 mils. The shape memory alloy was then heat treated at 550° C. for 10 minutes in an oven and air cooled to room temperature to induce the potential for one-way memory. During one-way cycling, oxidation scales appearing on the surface of the alloy were also sheared. The sample was clamped within the work hardening apparatus of FIG. 7 and plastically deformed to about 6%. Each side of the shape memory alloy ribbon was then subjected to grit blasting at temperatures no higher than −60° F. using 10–15 mils nominal diameter glass beads at a pressure of 35 psi for 20 seconds per square inch. The resultant strain versus temperature is 2.5% and is illustrated in FIG. 9.

Inasmuch as the linear elasticity of the converted Ni-Ti is about 4%, it is expected that the potential strain amplitude limit for the two-way memory effect will likely be no higher than 4%. In practice, two-way strain amplitudes of about half of the one-way recovery are rendered. For, Ni-Ti, the one-way memory limit is about 8%.

Figure 10:
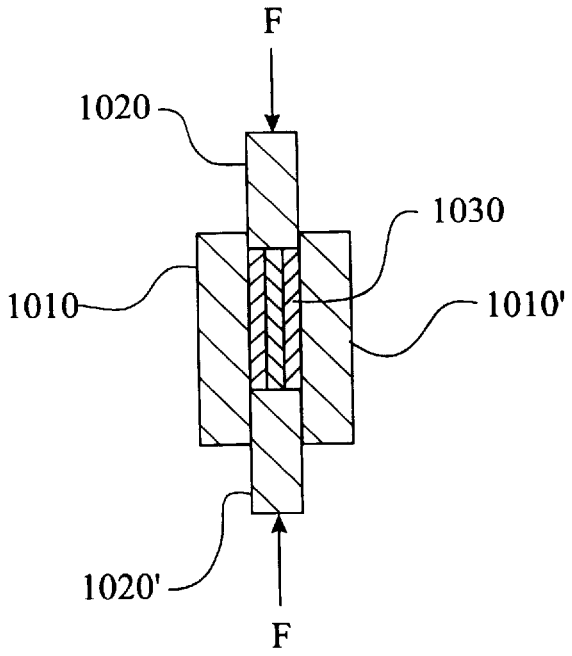
FIG. 10 is a cross sectional view of a shape memory element(s) being pre-strained to produce tensile expansion upon heating.

It should be clearly understood that two-way shape memory elements may also be processed to provide force and movement in expansion (upon heating), bending or torsion. For example, two-way shape memory alloy elements may be processed to expand, contract, twist or bend when heated through their transformation temperature range. As shown in FIG. 10, retaining blocks 1010, 1010' and pressure blocks 1020, 1020' may be used by applying a force F to pre-process a shape memory element(s) 1030 for expansion upon heating and contraction upon cooling. Shape memory element 1030 is sandwiched longitudinally between retaining blocks 1010, 1010'. Pressure blocks 1020, 1020' may be used to compress (force, F) shape memory alloy 1030 to a desired amount without causing the element to buckle. For shape memory elements in the form of a strip, wire or tube, additional retainer blocks may be used to sufficiently restrain the element from buckling under compression. To treat a thin ribbon, multiple ribbons may be placed in the retaining blocks. In the case of a tube, an incompressible plug within the bore of the tube may be used instead. After such plastic deformation, shape memory element 1030 is placed in the grit blasting apparatus of FIG. 6 or any other suitable fixture, and then work hardened so as to change the physical properties of the affected surfaces of the element.

Figure 11:
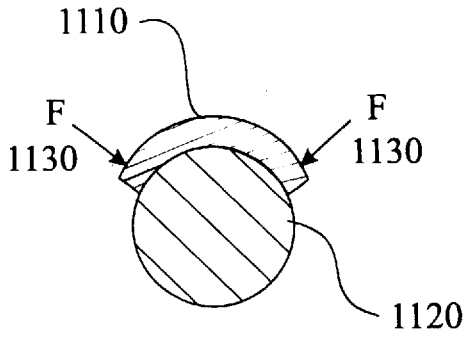
FIG. 11 is a cross sectional view of a shape memory element being pre-strained to produce a bending movement upon activation.

A two-way bending effect may also be induced in a likewise similar manner. Referring to FIG. 11, a flat one-way shape memory element 1110 may be plastically deformed over a curved mandrel 1120 by applying a force, F, 1130 of sufficient magnitude substantially perpendicular to the outer surface of shape memory element 1110 and inwardly toward the center of mandrel 1120. Shape memory elements in the form of a rod or tube may also be bent in a similar manner. In this latter instance, kinking may be avoided by inserting a flexible wire, cable or frozen chemical within the tube before bending.

Figure 12:
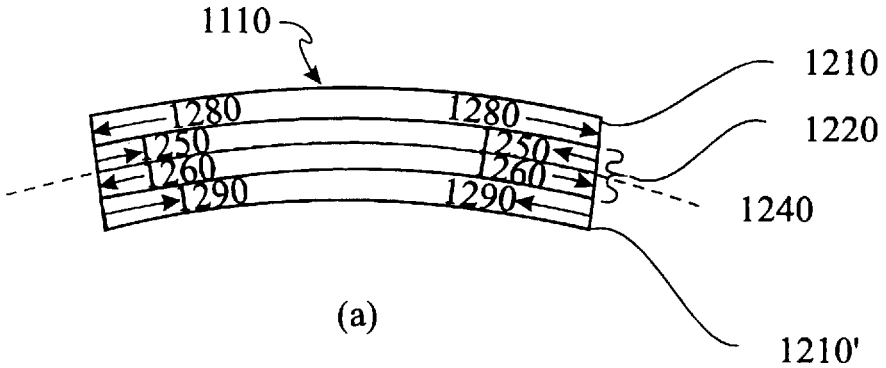
FIGS. 12(*a*) and (*b*) are representations of the internal mechanisms of bending for a two-way shape memory element.
Figure 12:
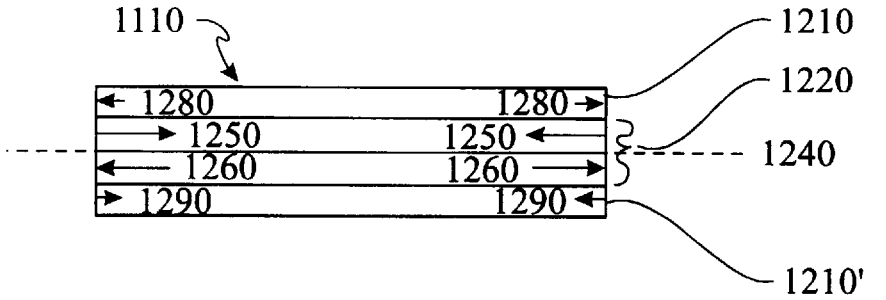

Work hardening the outer surface of the plastically deformed element 1110 such that it exhibits super-elasticity effectively creates four mechanically significant regions, as illustrated in FIG. 12(*a*). In addition to super-elastic regions 1210, 1210', the processed shape memory element 1110 functionally consists of one-way shape memory region 1220 centered about a neutral axis of bending 1240. Region 1220 has equal and opposite stresses 1250 and 1260, as illustrated.

Cooling shape memory alloy region 1220 into its transformation temperature range, transforms the region into its soft state. Stresses 1280 (compressional, but expanding) and 1290 (tensile) increasingly exceed stresses 1260 (tensile) and 1250 (compressive), respectively, causing the shape memory element to bend. When this occurs, stresses 1280 (compressive) and 1290 (tensile) grow weaker until balanced by the counteracting yield stresses exerted by 1250 (tensile) and 1260 (compressive). Shape memory element 1110 maintains this shape unless reheated into its transformation temperature range.

As shape memory element 1110 is heated through its transformation temperature range, contractive and expansive forces develop due to stresses 1250, 1260, respectively, which in turn generate an internal bending moment. Although stresses 1250, 1260 exceed counteracting stress 1290 (tensile) and stress 1280 (compressional) associated with super-elastic alloy regions 1210, 1210', as element 1110 recovers its original set shape, stresses 1250, 1260 weaken until balanced by stresses 1280, 1290. At this latter point, the element stops deforming and retains that state unless cooled into its transformation temperature range. By virtue of this process, the element can be made then to bend between any two bending shapes within the surface strain amplitude limit through temperatures changes alone.

Figure 13:
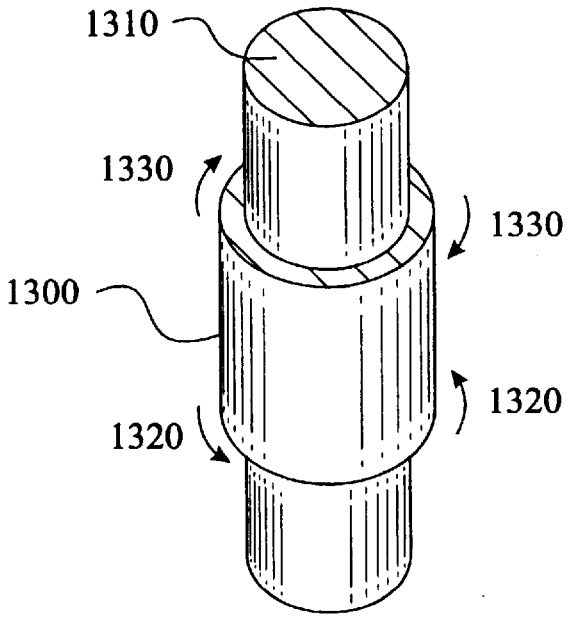
FIG. 13 is perspective view of a shape memory element being pre-strained to produce torsional movement upon activation.
Figure 14:
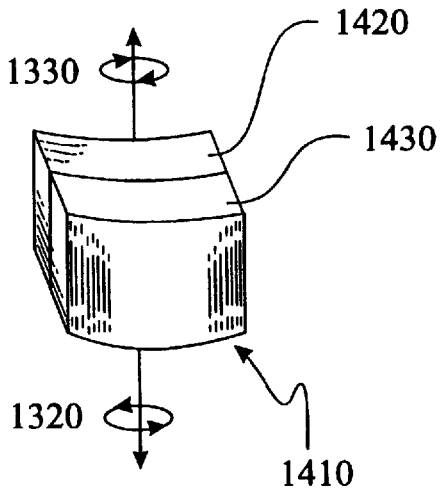
FIGS. 14 and 15 are perspective views of a section of the shape memory element of FIG. 13 illustrating the internal mechanics of two-way torsional movement.

Alternatively, shape memory elements may be processed to provide torsional movement. Such elements can be in the form of a bar, wire, spring or tube. For example, a shape memory element 1300 in the form of a tube may be placed longitudinally and concentrically over a cylindrical mandrel 1310, as depicted in FIG. 13. Applying counter opposing torque moments 1320 and 1330 along the distal ends of element 1300 induces torsional deformation within the element without inducing buckling. Work hardening may likewise be effected through grit blasting the outer and/or the inner surface of the shape memory element. To construe a torsional two-way element actuator, a section 1410 of the tube wall of shape memory element 1300 may be extracted as depicted in FIG. 14. It should be understood that the curvature of section 1410 runs into the plane of the paper with its length running from top to bottom. Work hardening only the outside surface of section 1410 while under torsional deformation yields a one-way shape memory region 1420 and a super-elastic region 1430. Torsional movements are generated from shear stresses induced between similar adjacent cross sections to a plane 1410 of the tube wall along the length of the tube.

Figure 15:
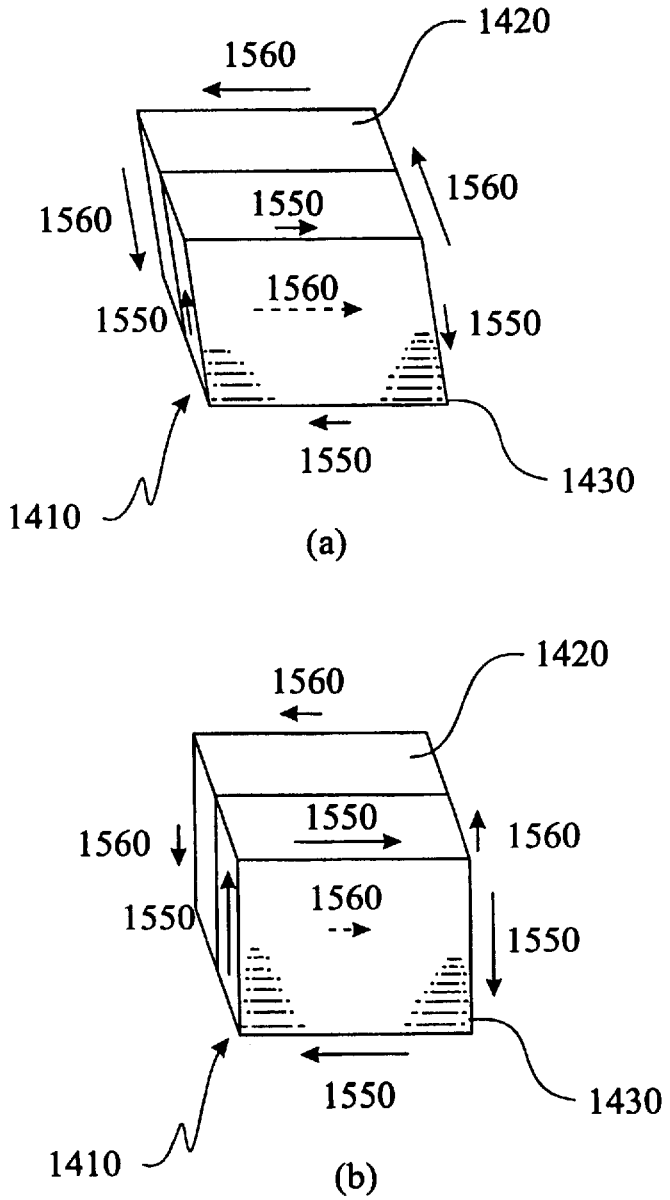

Cooling into the transformation temperature range causes stresses within super-elastic region 1430 to dominate. Referring to FIG. 15(b), an elastic shear stress 1550 plastically deforms the softening one-way shape memory region 1420. Under torsional movement, elastic shear stress 1550 weakens until reaching its original set shape. Again, this latter shape is maintained provided the shape memory element is not heated into its transformation temperature range. As it is heated through the transformation temperature range, the one-way effect of shape memory region 1420 dominates within the element. Developed shear stress 1560 deforms element 1410 until it is balanced by elastic shear stress 1550. The depicted shape of FIG. 15(*a*) is maintained unless shape memory region 1420 is cooled into its transformation temperature range.

Figure 16:
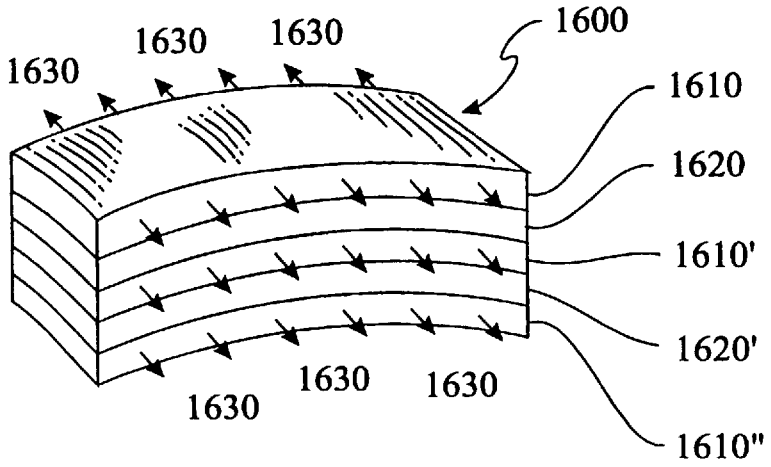
FIG. 16 is a perspective view of an actuator comprising multiple two-way shape memory alloy layers processed in accordance with the principles of the present invention.

For the various embodiments above, as the thickness of the shape memory element increases, it is believed that such elements may have a limited performance potential. Accordingly, shape memory alloy actuators should preferably be made from thin sheets of elements so as to maximize the ratio of the surface area to volume, thereby allowing rapid heating and cooling which minimizes cycle time. For many design applications, thin sheet actuators also may have an inadequate force output. Accordingly, it is contemplated that two-way actuators may be construed by layering multiple sheets of two-way treated shape memory alloy sheets in accordance with the principles of the present invention, as show in FIG. 16. Using many layers increases the net force output additively. Actuator 1600 is a flat or curved segment, consisting of alternating layers of two-way memory layers 1610, 1610', 1610" and heating layers 1620, 1620'. Heating layers 1620, 1620' heat two-way layers 1610, 1610', 1610" so as to cause transformation and movement, with arrows 1630 depicting the direction of movement. Preferably, heating layers 1620, 1620', are each a thin electrothermal film, such as those sold by Minco, Inc. or any other suitable vendor. It should be clearly understood that interposing the heating layers between the shape memory layers increases the heating efficiency.

For tensile shape memory alloy actuators, curving the shape memory sheets in the plane parallel to the direction of movement increases its buckling resistance. For concentric multiple tube-type actuators, a former within the control tube core may be used to provide resistance to buckling. The former, the additional outer layers, or the layers between the shape memory sheets can serve as a heat sink to conduct away the heat and cool the actuator after activation.

Figure 17:
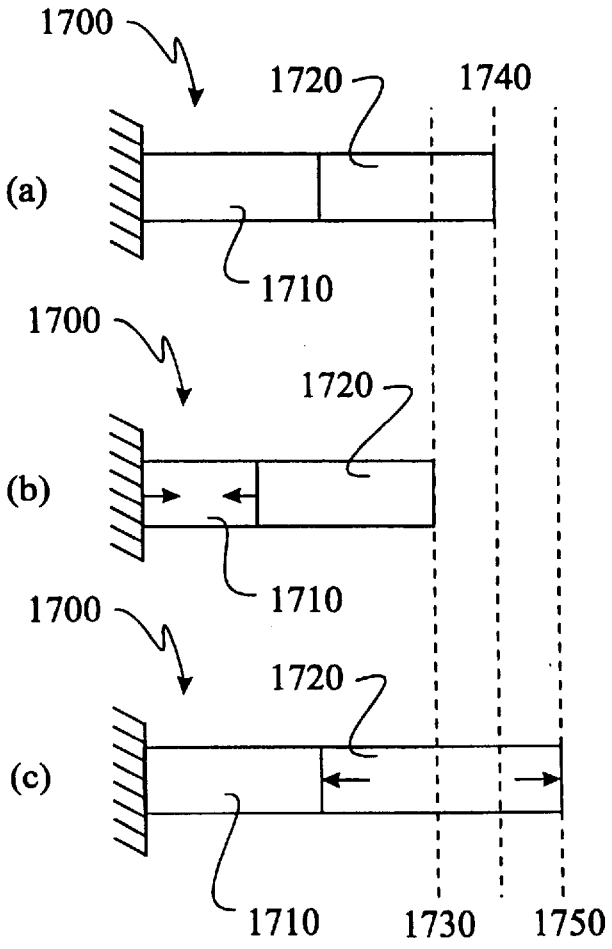
FIGS. 17(*a*)–(*c*) are side views of a bi-directional actuator made from two-way shape memory elements in accordance with the principles of the present invention.

Shown in FIG. 17 is another embodiment of an actuator unit 1700 employing two-way shape memory elements processed in accordance with the present invention. More particularly, actuator unit 1700 comprises a pair of two-way actuators 1710 and 1720, each operating in a tensile strain mode. Actuator 1710 when heated contracts whereas actuator 1720 expands. An end portion, however, remains fixed. If actuators 1710 and 1720 are both heated simultaneously, no net movement results. If, actuator 1710 is only heated, strain amplitude 1730 (contraction) results. Similarly, if actuator 1720 is only heated, strain amplitude 1750 (expansion) results. In this manner, selectively heating portions of actuator 1700 results in a push or pull effect which can be cycled in a two-way fashion by subsequently cooling the activated actuator or subsequently heating the other actuator. Preferably, for extended operating periods, insulation may be used between actuators 1710 and 1720.

Figure 18:
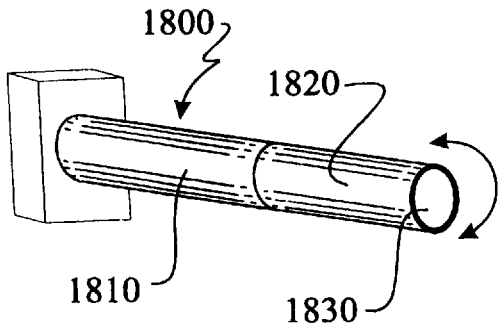
FIG. 18 is a perspective view of a bi-directional actuator made from two-way shape memory elements operating in a torsional mode.

Shown in FIG. 18 is still another embodiment of a bi-directional torsion actuator 1800 employing two-way shape memory elements processed in accordance with the present invention. Actuator 1800 comprises a clockwise rotating two-way shape memory element 1810 and a counter-clockwise rotating two-way shape memory element 1820. If shape memory element 1810 is only heated then a free end portion 1830 thereof rotates clockwise. only heating shape memory element 1820 results, however, in a counter-clockwise movement. With the simultaneous heating of shape memory elements 1810 and 1820, there is no movement. Insulation may be used between shape memory elements 1810 and 1820 so that heat activating one element does not also activate the other.

Figure 19:
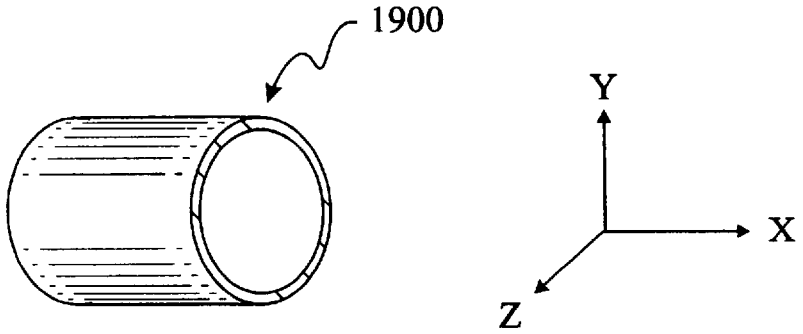
FIG. 19 is a perspective view of a bi-directional actuator made from two-way shape memory elements operating in a bending mode.
Figure 20:
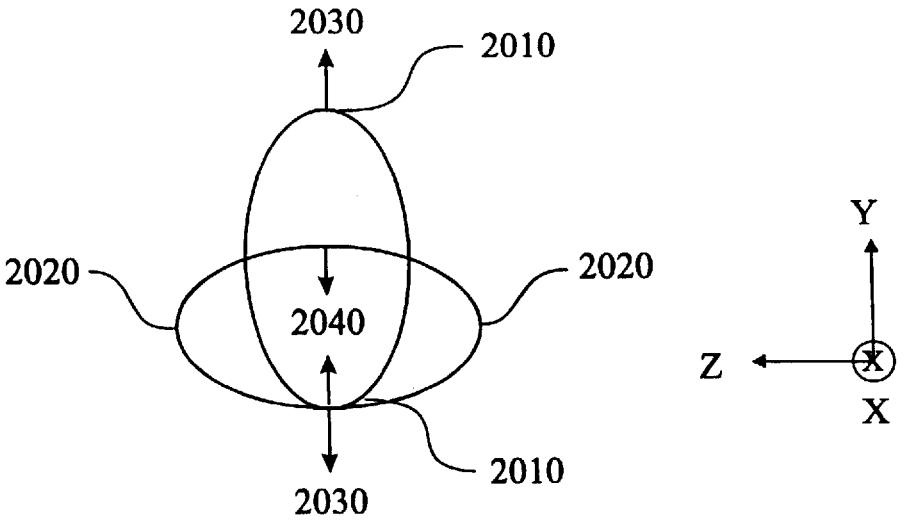
FIG. 20 is a depiction of the mechanics of the bi-directional actuator of FIG. 19 useful in illustrating its operation.

In yet still another embodiment, shown in FIG. 19 is a bi-directional bending actuator 1900 employing two-way shape memory element processed in accordance with the principles of the present invention. Actuator 1900 is fabricated as a tube-like element and consists of functional regions 2010 and 2020 as illustrated in FIG. 20. Shape memory region 2010 covers approximately the uppermost and lower most quadrants of tube-like actuator 1900. Shape memory region 2020 covers the quadrants of the left and right sides of the tube-like actuator. In particular, shape memory region 1910 is treated to exert movement along a direction 2030 when heated to activation. Similarly, shape memory region 2020 is treated to cause movement along a direction 2040 when heated. When shape memory regions 2010 and 2020 are heated simultaneously, however, actuator 1900 assumes a substantially round shape. For extended operations, the regions must be thermally isolated from each other. For example, actuator 1900 may be made from separate regions and then joined into the tube shape with insulation inserted between the regions. Furthermore, heat sinks may be used to remove the heat from the shape memory regions.

It should be clearly understood that the two-way shape memory elements in accordance with the principles of the present invention are treated so as to consist of essentially two regions, one of which is a one-way shape memory region while the other is a converted super-elastic region that constructively counters the one-way memory movement of the other region. The material may be produced in the form of bars, wires, sheets, tubes, springs and may be formed into basic shapes using conventional methods. Any shape memory alloy which may be processed to exhibit one-way memory may be treated in accordance with the principles of the invention to further exhibit two-way memory, including Cu-Al-Ni, Cu-Al, Cu-Zn-Al, Ti-V, Ti-Nb, Ni-Ti and Ni-Ti-Cu alloys. The degree to which the elements exhibit two-way memory, however, is limited by their one-way memory recovery ability as well as by the degree to which the elements may be work hardened to form a suitable elastic region.

It should therefore be understood that the embodiments herein are merely illustrative of the principles of the invention. Various modifications may be made by those skilled in the art which will embody the principles of the invention and fall within the spirit and the scope thereof. For example, shape memory elements may be plastically deformed along two different axes prior to work hardening the outer and/or inner surface of the element. In this manner, a repeatable two-way movement along two dimensions can be achieved, rather than only along one dimension.

I claim:

1. A method for producing a two-way shape memory alloy element comprising the steps of:

treating a shape memory alloy element to exhibit a one-way memory effect, thereby creating a one-way shape memory alloy element having limits in its ability to recover from a deformed shaped if heated above its transformation temperature;

deforming said one-way shape memory alloy element substantially to the limits of its ability to recover its shape; and subsequent to said deforming step. work hardening a portion of said deformed one-way shape memory alloy element, thereby converting a region of said work hardened portion into an elastic region which counteracts the one-way shape memory effect and creating a two-way shape memory alloy element.

2. The method of claim 1 wherein said elastic region is a super-elastic region.

3. The method of claim 1 wherein said step of deforming said one-way shape memory alloy element is induced by a tensile load.

4. The method of claim 1 wherein said step of deforming said one-way shape memory alloy element is induced by a compressive load.

5. The method of claim 1 wherein said step of deforming said one-way shape memory alloy element is induced by a torsion load.

6. The method of claim 1 wherein said step of deforming said one-way shape memory alloy element is induced by a bending load.

7. The method of claim 1 wherein said one-way shape memory alloy element is work hardened by grit blasting.

8. The method of claim 7 wherein said grit blasting includes bombarding said one-way shape memory alloy element with abrasive particles.

9. The method of claim 1 wherein said one-way shape memory alloy element includes a Ni-Ti, Ni-Ti-Cu, Cu-Al-Ni, Cu-Al, Cu-Zn-Al, Ti-V, or Ti-Nb alloy.

10. The method of claim 1 further comprising the step of layering two or more of said two-way shape memory alloy elements, thereby producing a two-way shape memory actuator.

11. The method of claim 1 further comprising the step of alternately layering said two-way shape memory alloy element and an electrothermal film, thereby producing a two-way shape memory actuator.

12. The method of claim 1 further comprising the step of joining a first and second of said two-way shape memory alloy elements, said first and second of said two-way shape memory alloy elements expanding and contracting, respectively, when heated into and above their respective transformation temperature range, thereby producing a two-way shape memory actuator.

13. The method of claim 1 further comprising the step of joining a first and second of said two-way shape memory alloy elements, said first and second of said two-way shape memory alloy elements rotating clockwise and counter-clockwise, respectively, when heated into and above their respective transformation temperature range, thereby producing a two-way shape memory actuator.

14. The method of claim 1 further comprising the step of joining a first and second of said two-way shape memory alloy elements, said first and second of said two-way shape memory alloy elements moving along a first and second direction, respectively, when heated into and above their respective transformation temperature range, thereby producing a two-way shape memory actuator.

15. The method of claim 1 wherein said two-way shape memory alloy element is in the shape of a bar, wire, spring, sheet, tube or ribbon.

16. A method for producing a two-way shape memory alloy element from a one-way shape memory alloy element having limits in its ability to recover from a deformed shape if heated above its transformation temperature, said method comprising the steps of:

deforming said one-way shape memory alloy element near or at the limits of its ability to recover its shape; and subsequently work hardening a portion of said deformed one-way shape memory alloy element, thereby converting a region of said work hardened portion into an elastic region which counteracts the one-way shape memory effect in said one-way shape memory alloy element, and creating a two-way shape memory alloy element.

17. The method of claim 16 wherein said elastic region is a super-elastic region.

18. The method of claim 16 wherein said step of deforming said one-way shape memory alloy element is induced by a tensile load.

19. The method of claim 16 wherein said step of deforming said one-way shape memory alloy element is induced by a compressive load.

20. The method of claim 16 wherein said step of deforming said one-way shape memory alloy element is induced by a torsion load.

21. The method of claim 16 wherein said step of deforming said one-way shape memory alloy element is induced by a bending load.

22. The method of claim 16 wherein said one-way shape memory alloy element is work hardened by grit blasting.

23. The method of claim 16 wherein said grit blasting includes bombarding said one-way shape memory alloy element with abrasive particles.

24. The method of claim 16 wherein said one-way shape memory alloy element includes a Ni-Ti, Ni-Ti-Cu, Cu-Al-Ni, Cu-Al, Cu-Zn-Al, Ti-V, or Ti-Nb alloy.

25. The method of claim 16 further comprising the step of layering at least two or more of said two-way shape memory alloy elements, thereby producing a two-way shape memory actuator.

26. The method of claim 16 further comprising the step of alternately layering said two-way shape memory alloy element and an electrothermal film, thereby producing a two-way shape memory actuator.

27. The method of claim 16 further comprising the step of joining a first and second of said two-way shape memory alloy elements, said first and second of said two-way shape memory alloy elements expanding and contracting, respectively, when heated into and above their respective transformation temperature range, thereby producing a two-way shape memory actuator.

28. The method of claim 16 further comprising the step of joining a first and second of said two-way shape memory alloy elements, said first and second of said two-way shape memory alloy elements rotating clockwise and counter-clockwise, respectively, when heated into and above their respective transformation temperature range. thereby producing a two-way shape memory actuator.

29. The method of claim 16 further comprising the step of joining a first and second of said two-way shape memory alloy elements, said first and second of said two-way shape memory alloy elements moving along a first and second direction, respectively, when heated into and above their respective transformation temperature range, thereby producing a two-way shape memory actuator.

30. The method of claim 16 wherein said two-way shape memory alloy element is in the shape of a bar, wire, sheet, tube, spring or ribbon.

* * * * *